US005352302A

United States Patent [19]

Takagi et al.

[11] Patent Number: 5,352,302

[45] Date of Patent: Oct. 4, 1994

[54] METHOD OF PRODUCING A RARE-EARTH PERMANENT MAGNET

[75] Inventors: Fumio Takagi; Osamu Kobayashi; Akira Arai; Seiji Ihara; Koji Akioka, all of Suwa, Japan

[73] Assignee: Seiko Epson Corporation, Tokyo, Japan

[21] Appl. No.: 955,748

[22] PCT Filed: Apr. 27, 1992

[86] PCT No.: PCT/JP92/00521

§ 371 Date: Oct. 16, 1992

§ 102(e) Date: Oct. 16, 1992

[87] PCT Pub. No.: WO92/20081

PCT Pub. Date: Nov. 12, 1992

[30] Foreign Application Priority Data

| | | | |
|---|---|---|---|
| Apr. 25, 1991 | [JP] | Japan | 3-95692 |
| Feb. 24, 1992 | [JP] | Japan | 4-036614 |
| Feb. 24, 1992 | [JP] | Japan | 4-036615 |
| Feb. 24, 1992 | [JP] | Japan | 4-036616 |
| Feb. 25, 1992 | [JP] | Japan | 4-037741 |

[51] Int. Cl.[5] ..... H01F 1/00

[52] U.S. Cl. ..... 148/101; 148/120; 148/121

[58] Field of Search ..... 148/101, 102, 120, 121, 148/122

[56] References Cited

U.S. PATENT DOCUMENTS

| | | | |
|---|---|---|---|
| 4,710,239 | 12/1987 | Lee et al. | 148/101 |
| 4,780,226 | 10/1988 | Sheets et al. | 258/28 |
| 4,921,551 | 5/1990 | Uernia et al. | 148/101 |
| 5,125,988 | 6/1992 | Akioka et al. | 148/101 |

FOREIGN PATENT DOCUMENTS

| | | | |
|---|---|---|---|
| 60-9328 | 3/1985 | Japan . | |
| 1-270210 | 10/1989 | Japan . | |
| 1175207 | 11/1989 | Japan . | |
| 2-7505 | 1/1990 | Japan . | |
| 2-252222 | 10/1990 | Japan . | |
| 2-297910 | 12/1990 | Japan . | |
| 4-134806 | 5/1992 | Japan | 148/101 |
| 4187722 | 6/1992 | Japan . | |
| 2206241 | 12/1988 | United Kingdom | 148/101 |

*Primary Examiner*—John P. Sheehan

*Attorney, Agent, or Firm*—Stroock & Stroock & Lavan

[57] ABSTRACT

A high-performance R—Fe—B permanent magnet being radially anisotropic can be produced by carrying out hot bending of a plateshaped magnet material produced by casting and hot working, to mold it into an arc shape; the cracks to be generated during the bending can be decreased by deciding such bending conditions as the amount of strain, the strain rate, the working temperature, as well as the structure and the composition of the alloy. Furthermore, by optimizing the conditions for heat-treatment and by using an oxidation resistance coating lubricant, an arc shape magnet of high performance and a low cost can be produced under stabilized conditions.

9 Claims, 2 Drawing Sheets

METHOD OF PRODUCING A RARE-EARTH PERMANENT MAGNET

DESCRIPTION

1. Technical Field

This invention relates to a method of producing a rare-earth permanent magnet and, more particularly, to such method for producing a R—Fe—B rare-earth permanent magnet, that makes a cast alloy magnetically anisotropic by hot plastic working.

2. Background Art

Typical permanent magnets used currently include a cast Alnico magnet, a Ferrite magnet and a rare-earth-transition metal magnet. Considerable work has been done especially on the R—Fe—B permanent magnet since it is a permanent magnet having very high coersive force and energy product.

Conventional methods for producing these rare-earth-iron (transition metal) permanent magnets of high performance include those given below.

(1) The publication of Japanese Patent Laid-Open Publication No.59-46008, and M. Sagawa, S. Fujimura, N. Togawa, H. Yamamoto and Y. Matsuura; J. Appl. Phys. Vol. 55(6), 15 March 1984, P2083, etc. disclose a permanent magnet which is featured by being an anisotropic sintered body comprising 8–30 atomic % of R (here R is at least one of rare-earth elements including Y), 2–28% of B, and the rest of Fe, and its production method by sintering process which is based on powder metallurgy. In the sintering process, an alloy ingot prepared by melting and casting, is crushed into a magnetic powder of an appropriate particle size (several μm). The magnetic powder is kneaded with an organic binder which is a molding aid, and molded by compaction molding under a magnetic field. The green body is sintered in an argon at a temperature around 1100° C. for 1 hour, then quickly cooled to room temperature. The coersive force is enhanced by carrying out a heat treatment at a temperature around 600° C. after the sintering. As for the heat treatment of the sintered magnet, effects of step heat treatment are disclosed in the publication of Japanese Patent Laid-Open Publication No. 61-217540, and in the publication of Japanese Patent Laid-Open Publication No. 62-165305 etc.

(2) The publication of Japanese Patent Laid-Open Publication No. 59-211549 and R. W. Lee; Appl. Phys. Lett. Vol. 46(8), 15 April 1985, P 790 discloses that a rare-earth iron magnet is produced by making a rapidly-quenched ribbon having a thickness of around 30 μm by melt spinning process using a melt-spinning apparatus which is generally used for producing an amorphous alloy, and by bonding the obtained thin ribbon with resin.

(3) Furthermore, the publication of Japanese Patent Laid-Open Publication No. 60-100402 and the above-mentioned paper of R. W. Lee disclose a production method of an anisotropic permanent magnet by high-temperature working, wherein the permanent magnet is an iron-rare-earth metal alloy, and the production process comprises high-temperature working of an amorphous or a fine crystalline solid material containing iron, neodymium and/or praseodymium and boron, production of a plastically deformed body, cooling the obtained body, and making the resulted body show magnetic anisotropy and permanent magnetic properties.

In this method of producing the magnets, the rapidly quenched ribbon or thin ribbon fragment described in the paragraph (2) is densified by hot presssing at around 700° C. in vacuum or in an innert gas atmosphere, then upsetting (die upset) is carried out until the thickness becomes ½ of the original thickness, so that the axis of easy magnetization is aligned along with the pressing direction and anisotropy is rendered. The publication of Japanese Patent Laid-Open Publication No. 2-308512 discloses a method in which a R—Fe—B alloy powder produced by rapidly quenching process is consolidated and warm plastic deformation is carried out to render anisotropy, and molded into an arc shape again under warm condition.

(4) The publication of Japanese Patent Laid-Open Publication No. 62-276803 discloses a method of producing a rare-earth iron permanent magnet which is featured by melting and casting an alloy made of 8–30 atomic % of R (here R is at least one of rare-earth elements including Y), 2–28 atomic % of B, less than or equal to 50 atomic % of Co, less than or equal to 15 atomic % of Al and the rest of iron and other unavoidable impurities during production, then carrying out such hot working of the cast alloy as extruding, rolling, stamping etc respectively at a temperature of more than or equal to 500° C., thereby refining the crystal grain, aligning the crystallographic axis in a specific direction and making the magnet anisotropic. The publication of Japanese Patent Laid-Open Publication No. 2-250918 shows a method of producing a permanent magnet having high degree alignment of easy magnetization direction of grains along the thickness reducing direction, by sealing a R—Fe—B ingot in a metal capsule and hot rolling the capsule.

The publication of Japanese Patent Laid-Open Publication No. 2-252222, and the publication of Japanese Patent Laid-Open Publication No. 2-315397 show a process in which the planar magnet material produced in the process of paragraph (4) is molded by hot bending process. The publication of Japanese Patent Laid-Open Publication No. 2-297910 discloses a method of producing a radially oriented magnet in which a casting alloy become magnetically anisotropic by hot rolling then molded into an arc shape by pressing.

The conventional methods of producing a R—Fe—B permanent magnet described in the above mentioned paragraphs (1)–(4) have the following defects.

Permanent magnet production method of paragraph (1) essentially requires pulverization of an alloy, however, since a R—Fe—B alloy is very active to oxygen, once it is pulverized, it is subjected to even higher oxidation to raise the oxygen content in the resulting sintered body.

Also, when the powder is aligned and molded in a magnetic field, a molding aid such as zinc stearate, for example, must be used, though it is removed in sintering process in advance, some 10 percent of the molding aid remains in the magnet as carbon, and that is not advantageous since the carbon lowers R—Fe—B's magnetic performance very much.

The mold obtained after adding the molding aid and carrying out press molding, is referred to as green body, which is very fragile and hard to be handled. Thus it is also a big weak point that it requires considerable work to put them side by side in good condition in a sintering furnace.

Because of these defects, generally speaking, the production of a R—Fe—B sintered magnet requires expensive equipments and the production method has a low productivity which leads to a high production cost of the magnet. Accordingly, the advantage of the R—Fe—B magnet having relatively inexpensive raw materials cannot be made use of.

Furthermore, though it is possible to make magnets radially oriented during a molding process under a magnetic field, shrinking is occured in the subsequent sintering process. Therefore, the size precision becomes low. And by the same reason, the products tend to have cracks to make the yield ratio extremely bad.

In the permanent magnet production methods of paragraphs (2) and (3), vacuum melt spinning apparatus is used, but, this apparatus has very low productivity nowadays, besides it is expensive. The permanent magnet of paragraph (2) is isotropic in principle, so it has low energy product and the squareness of hysteresis loop is not good either, it is disadvantageous from the view point of both the temperature properties and its practical use.

The permanent magnet production process of paragraph (3) is a unique process utilizing hot pressing in two stages, however, it cannot be denied that it is not efficient from the practical view point of mass production. The publication of Japanese Patent Laid-Open Publication No. 2-308512 discloses a method in which a R—Fe—B alloy powder produced by rapid quenching process is consolidated, then warm plastic deformation is carried out to make consolidated body magnetically anisotropic, and it is molded into an arc shape again at high temperature. However, this process means hot pressing is carried out in three stages, and accordingly, it is inefficient. Besides, in this method, the crystal grain coarsen at a high temperature, therefore, the intrinsic coersive force, iHc, lowers very much, and the magnet produced by this method can not be practical. In an alternative method, radially anisotropic magnets can be produced by backward extrusion following the hot pressing. This method, however has low productivity and the produced magnet shows low mechanical strength.

As described above, in the conventional production methods including the powder process, have a problem especially in the field of a high-performance radially oriented rare-earth magnet, that a practical magnet from the view point of the quality and the cost, cannot be produced.

The permanent magnet production method of paragraph (4) has many advantages. Since the magnet alloy is sealed in a capsule, the hot working can be carried out in air, the control of the atmosphere during the working is not required, i.e. no expensive equipment is necessary. The production step as a whole is simple, thus the production cost is low. Since it does not comprise the powder process, the concentration of the included oxygen becomes low and the corrosion resistance is improved. The mechanical strength is high and a large size magnet can be produced. Especially when rolling is employed as a means for hot working, the mass productivity is improved. Such production method is suitable for mass production of a large sized magnet, however, for producing a magnet having a complicated shape, a disc shape or a ring shape, since working cost for cutting and grinding etc is required, and the yield ratio is low, it has a problem that the overall production cost becomes high.

For this problem, the publications of Japanese Patent Laid-Open Publication No. 2-252222, and Japanese Patent Laid-Open Publication No. 2-315397 disclose a process in which the plateshaped magnet is molded by hot bending. The process utilizes such a quality of the magnet material which contains very brittle $R_2Fe_{14}B$ intermetallic compound as the main phase, but it also contains a grain boundary phase having a low melting point, and it is in slush condition at a high temperature thus the plastic deformation can be easily carried out. By the bending, molding with high dimensional precision can be carried out thus the efficient production of the high performance radially oriented magnets can be carried out which has been difficult to be done by the sintering process or the die upsetting process. The magnet produced in this method inherits such features of the magnet produced by casting and hot working, that are high performance and high mechanical strength.

As a result of follow-up examination, it was found that the above mentioned bending process depends on the bending strain, the strain rate, the working temperature and the plate's thickness, and often tends to generate cracks. It was also found that such conditions as the amount of bending strain, the composition and the heat treatment must be decided in order to obtain high magnetic properties. The publication of Japanese Patent Laid-Open Publication No. 2-315397 shows that the working temperature must be 600°-1050° C. and the strain rate must be controlled to be less than or equal to 0.5/s, to carry out the bending without generating cracks, however, the publication of Japanese Patent Laid-Open Publication No.2-252222 shows no detailed description on the relation between the bending conditions and the cracks or magnetic properties. The publication of Japanese Patent Laid-Open 2-297910 discloses a method in which a cast alloy is magnetically aligned by hot rolling, molded into an arc shape by pressing, to produce a radially oriented magnet, but the follow-up examination on the conditions described as optimal there showed that many cracks were generated during the hot rolling and the bending processes. It was caused by employing no sheath during the rolling, too much thickness reduction (80%), and the low working temperature (800° C.).

The present invention is to eliminate the above mentioned disadvantages in the conventional bending of a rare-earth permanent magnet, more particularly, to solve the problems of deterioration of magnetic properties and cracking, by deciding the bending conditions and the structure and the composition of the magnet alloy in detail, and its purpose is to provide permanent magnets with a high performance and a low cost.

DISCLOSURE OF THE INVENTION

The present invention comprises melting and casting an alloy comprising R (R is at least one of rare-earth elements including Y), Fe (iron) and B (boron) as basic constituents, carrying out hot working to make the alloy magnetically anisotropic, and carrying out hot bending of the permanent magnet material having a plate shape, and is characterized by (1) carrying out the molding in such a way that maximum bending strain which is expressed as $\epsilon max = t/(2r+t)$ (wherein r is a curvature radius of an internal surface, and t is a thickness of the plate) becomes less than or equal to 0.2.

(2) carrying out the molding at a temperature of 900°-1050° C. and at such a working speed that the strain rate becomes less than or equal to $1\times10^{-3}$/s, so that the maximum amount of strain $\epsilon max$ becomes 0.05–0.2.

(3) making the magnet radially oriented by making the radial direction of the curved plane in accord with the plate's thickness direction.

(4) deciding the composition of the permanent magnet alloy, which is expressed, in terms of atomic %, as $R_xFe_yB_zM_{100-x-y-z}$ (here, M is at least one of Al, Ga, In, Si, Sn and transition metal elements excluding Fe, and a case in which 100—x—y—z=0 is included), by $x-2z>0$, $y-14z>0$, and $5 \leqq 100-17z \leqq 35$.

(5) the average crystal grain diameter of the permanent magnet alloy prior to the bending, being less than or equal to 40 μm.

(6) carrying out heat treatment at 250°–1100° C. after the bending.

(7) carrying out heat treatment at 500°–1100° C. for 2–24 hours and at 200°–700° C. for 2–24 hours, following the bending, and the cooling speed to be employed is less than or equal to 20° C./min.

(8) coating a lubricant for an oxidation resisting coat on the permanent magnet material.

The detailed conditions for producing a high performance arc shape magnet which is free from cracks by hot bending process, in the present invention will be explained as below.

Firstly, it is required to decide a shape of a magnet which can be molded by bending. During the bending, compressive strain occurs inside of a neutral plane which exists in the center of the plate thickness, and tensile strain occurs outside of that plane. If the distortion in the direction of the plate width is negligibly small, the compressive strain and elongation strain are considered to be corresponding to the bending strain. The bending strain reaches its maximum value on the inner and outer surfaces of the plate material, and when the curvature radius of the internal surface is expressed as r, the plate thickness is expressed as t, the maximum bending strain $\epsilon max$ can be expressed as $$\epsilon max = t/(2r+t).$$

The limit of the maximum bending strain to cause the cracks depends the working temperature and the strain rate. The higher the temperature is, with the upper limit of 1050° C. and the smaller the strain rate is, the bigger the maximum bending strain becomes. As a result of many experiments, it was found that the limit of the maximum bending strain is 0.2. When the strain reaches a value bigger than this, not only the cracks tend to be generated more easily, but also the bending strain distorts the high degree of alignment obtained by the rolling and pressing.

Secondly, when the bending strain is big, especially when $\epsilon max$ is more than or equal to 0.05, the working temperature and the strain rate are subject to limitation. The R—Fe—B-permanent magnet of the present invention mainly consists of a $R_2Fe_{14}B$ intermetallic compound as the main phase and a R-rich phase. Its plastic deformation under hot condition is considered to be caused substantially by grain boundary slip, which is different from the cases of ordinary metals or alloys. For uniformed deformation, the strain rate must be sufficiently small and the temperature must be as high as possible in order to decrease the deformation resistance. That means, when the maximum bending strain is more than or equal to 0.05, the working temperature must be at least more than or equal to 900° C. The upper limit is 1050° C., and if the temperature exceeds it, grain growth occurs to lower the magnetic characteristics very much.

During the guided bending into an arc shape, when the lowering speed of a punch is constant, the strain rate becomes the maximum in the initial stage of the working. In such a stage, the strain rate can be easily calculated since the situation is the same as that for three-point bending. When the plate's thickness is shown as t, the working speed (the lowering speed of the punch) is shown as v, and the span of the three-point bending is shown as L, the strain rate is expressed as $$6tv/L^2.$$

If the strain rate is less than or equal to $1\times10^{-3}$/s, almost no cracks are generated. Provided that, when the strain exceeds 0.2, the cracks are generated even under such condition, and the yield ratio is lowered very much.

Thirdly, a radially oriented magnet is produced by making the direction of the anisotropy rendered by hot working, in accord with the radial direction of an arc shape produced by bending. By employing rolling as a hot working means, a large sized plateshaped magnet can be mass-produced, thus by the subsequent bending enables a mass production of a radially oriented magnet, and the production cost is reduced. Since magnetic alignment is occured in the plate's thickness direction by the rolling, then it is molded into a circular arc shape etc, the product shows good degree of alignment. Accordingly, the magnetic properties are high, and (BH)max exceeding 25 MGOe can be obtained.

Fourthly, the composition of the R—Fe—B permanent magnet in the bending of the present invention is decided. As the rare-earth element, Y, La, Ce, Pr, Nd, Sm, Eu, Gd, Tb, Dy, Ho, Er, Tm, Yb and Lu can be employed, and one or more of them are combined and used. As the highest magnetic performance is obtained with Pr, for the practical use, Pr, Pr-Nd alloy, Ce-Pr-Nd alloy etc are used. A small amount of heavy rare-earth element such as Dy and Tb etc is effective for enhancing the coersive force.

The main phase of R—Fe—B magnet is $R_2Fe_{14}B$. Accordingly, if the amount of R is below 8 atomic %, the above mentioned intermetallic compound is not any more formed, and the high magnetic properties cannot be obtained. On the other hand, if R exceeds 30 atomic %, the amount of non-magnetic R-rich phase is increased, and the magnetic properties are degradated very much. Accordingly, an appropriate range of R is 8–30 atomic %. For the high residual flux density, however, an appropriate range of R is preferably 8–25 atomic %.

B is an essential element for forming $R_2Fe_{14}B$ phase, and when B is below 2 atomic %, it becomes rhombohedral R-Fe system, thus high coersive force cannot be expected. When the amount of B exceeds 28 atomic %, the amount of R-rich non-magnetic phase is increased and the residual flux density is very much lowered. To obtain high coersive force, B is preferably less than or equal to 8 atomic %, and if B exceeds it, it is difficult to obtain fine $R_2Fe_{14}B$ phase and the coersive force becomes small.

As a metal element M, the following metals are preferable. Co is an effective element to increase the Curie point of the magnet of this invention, however, since it decreases the coersive force, the amount of Co is preferably less than or equal to 50 atomic %. Such an element as Cu, Ag, Au, Pd and Ga that exists together with R rich phase and lowers the melting point of the phase has an effect of enhancing the coersive force, however, since these elements are non-magnetic elements, when their amounts are increased, the resulting residual flux density is decreased, thus the ratio is preferably less than or equal to 6 atomic %.

In the above mentioned preferable composition range, the composition of the alloy, which is expressed as $$R_xFe_yB_2M_{100-x-y-z}$$

(wherein M is at least one of Al, Ga, In, Si, Sn and transition metal elements including Fe, and the case in which $100-x-y-z=0$ is included) is preferably in such composition range that is defined by $x-2z>0$
$y-14z>0$
$5\leqq 100-17z\leqq 35.$ In the composition region where $x-2z\leqq 0$, $y-14z\leqq 0$, B rich phase appears, which hinders the deformation during the hot working, and causes the cracks during the hot working and bending. It is also responsible for lowering the magnetic properties. As the magnetic $R_2Fe_{14}B$ phase is hard and brittle, it is hard to carry out plastic deformation thus the hot bending process requires the co-presence of grain boundary phase of a low melting point. When $100-17z>35$, the ratio of the grain boundary phase is too high, the ratio of $R_2Fe_{14}B$ phase is small, and high residual flux density cannot be obtained, and the magnetic properties is lowered. When $100-17z<5$, the amount of the grain boundary phase is not sufficient for carrying out the plastic deformation and the deformation is hindered, it causes cracks during the bending. Accordingly, in order to carry out the hot bending of the plateshaped magnet alloy without generating cracks, the composition range of $5\leqq 100-17z\leqq 35$ is further preferable.

Fifthly, an average grain diameter of a permanent magnet alloy used for the bending is defined. That is, if the average crystal grain particle prior to the bending is less than or equal to 40 μm, the working can be easily carried out without generating cracks. By removing a step of causing grain growth following the hot working, such as long time heat treatment at a temperature over 1100° C. following the rolling, the deterioration of the workability due to the crystal grain growth can be prevented, and the bending can be carried out easily and the generation of the cracks can be suppressed.

Sixthly, high magnetic properties can be obtained by heat treatment following the bending. The heat treatment temperature after the bending is preferably more than or equal to 250° C., in order to relax the residual strain, to clean grain boundary and to obtain high coersive force by diffusing Fe of primary crystal. If the temperature exceeds 1100° C., grain growth of the $R_2Fe_{14}B$ phase occurs rapidly to lose the coersive force, a temperature less than or equal to that is preferable. For the heat treatment, the atmosphere is preferably an inactive gas such as argon, in order to prevent the oxidation of the alloy.

Seventhly, further higher coersive force and energy product are obtained by carrying out heat treatment in two stages, following the bending. And by keeping the cooling speed less than or equal to 20° C./min, the generation of the cracks due to the heat shrinkage can be suppressed. The heat treatment of the first stage requires 500°-1100° C. for 2-24 hours. In this stage, the cleaning of the grain boundary and Fe diffusion of the primary crystal occurs. Sufficient diffusion does not occur at a temperature below 500° C., and if the temperature exceeds 1100° C., a grain growth occurs to lower the coersive force. The heat treatment of the second stage requires 200°-700° C. for 2-24 hours. At this stage, non-magnetic phase is precipitated in grain boundary and high coersive force is obtained. The optimal heat treatment temperature varies if there is any additive element, and the kind of the additive element, and in the case when Cu is added, the most effective temperature is 450°-550 ° C. The cooling speed after the bending is preferably less than or equal to 20° C./min. If it is faster than this, cracks tend to be generated by heat shrinkage.

Eighthly, by the use of a lubricant for an oxidation resistance coating, the oxidation of the material even in air at a high temperature can be suppressed as well. Accordingly, the bending of the magnet material can be carried out in air, and as the result, the bending cost can be lowered. There are two kinds of lubricants for the oxidation resistance coating, i.e. graphite type and glass type lubricants. Both of them have a stabilized lubricating effect at a high temperature, prevent concentration of strain, and suppress generation of the cracks and are effective as a mold releasing agent as well. When the graphite is used at a high temperature it is mixed with glass. The graphite adsorbs oxygen on the surface to control the supply of the oxygen to the material. The glass type lubricant is melted at a high temperature to cover the material and isolate it from the external air to suppress the oxidation.

BRIEF DESCRIPTION OF THE DRAWINGS

FIG. 2(*a*) shows a condition prior to the bending; and

FIG. 2(*b*) shows a condition after the bending is carried out.

THE BEST MODE FOR CARRYING OUT THE INVENTION

In order to explain the present invention in greater detail, some embodiments will be described.

Embodiment 1

An alloy having the composition of $Pr_{17}Fe_{76.5}B_5Cu_{1.5}$ was melted in argon atmosphere using an induction furnace then it was cast to produce an ingot having a length of 150 mm, a height of 140 mm, and a thickness of 20 mm, comprising columnar structure having an average grain size of 15 μm. Here, as the raw materials for the rare-earth element, iron and copper, those having the purity of 99.9% were used and as the boron, ferroboron was used.

Figure 1:
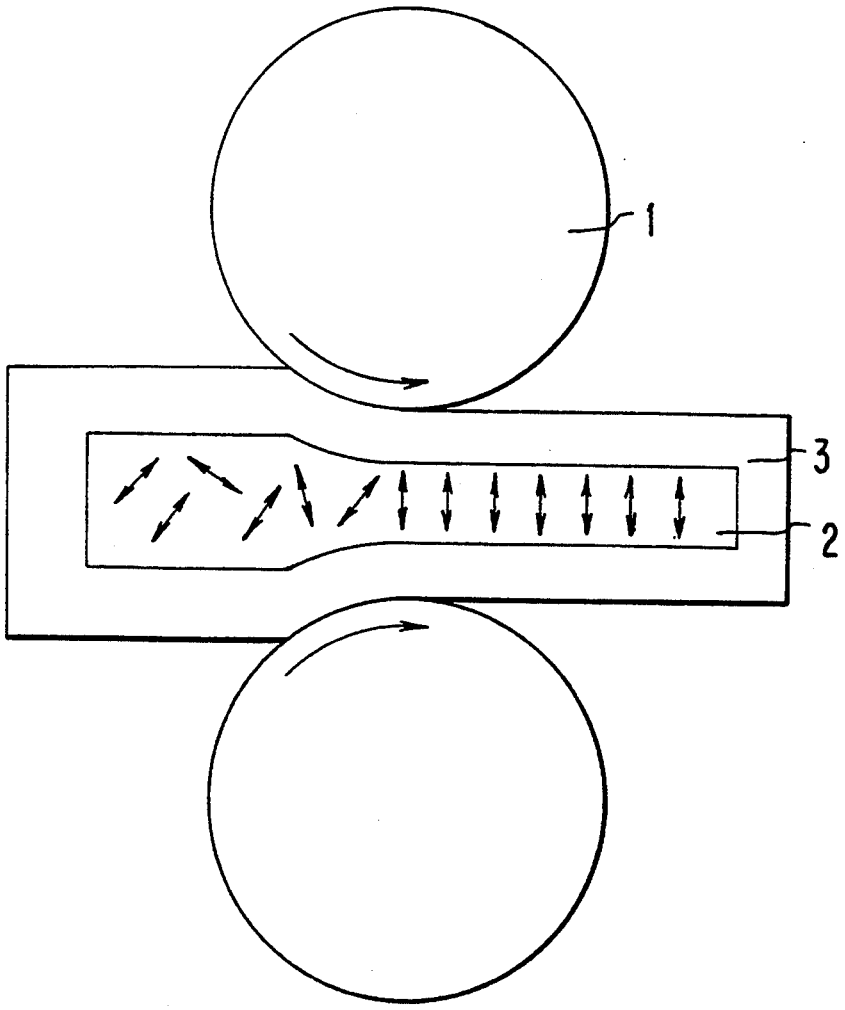
FIG. 1 is a schematic view illustrating the rolling used in accordance with an embodiment of the invention.

A billet having a length of 145 mm, a height of 38 mm, and a thickness of 18 mm was cut out from the cast ingot by cutting and grinding, and as it is shown in the FIG. 1, the billet 3 was put into a sheath 2 made of SS41, and evacuated, sealed by welding, and heated in a furnace at 950° C. for 1 hour, then rolled with rolling machine to which a roll 1 having a diameter of 300 mm was attached. The rolling was carried out four times at a thickness reduction rate of 30% a pass. Circumferential speed of the roll is 10 m/min, the overall thickness reduction by the rolling was 76%. By the rolling, an axis of easy magnetization was aligned in parallel with the plate's thickness direction. After cooling, the sheath 2 was removed, and it was machined to produce a plate-shaped sample 5 having a width of 10 mm, a length of 40 mm, and a thickness of t (t=2,3,4,5 and 6 mm).

The plateshaped sample was heated in argon atmosphere at 1000° C., then press bending was carried out using bending dies which were heated at the same temperature, to produce an arc shaped magnet whose curvature radius of the internal surface was 10 mm. The strain rate employed was $1\times10^{-4}$/s.

After the working, the sample was heat-treated at 1000° C. for 2 hours, and at 500° C. for 2 hours respectively in argon atmosphere, then cut out into a desired shape, magnetized in pulse magnetic field of 4 tesla, and the magnetic characteristics were measured by VSM and BH tracer.

The results are shown in Table 1.

TABLE 1

| No. | plate's thickness | max curvature strain | cracks | (BH)max (MGOe) |
|---|---|---|---|---|
| 0 | 2 mm | 0 | — | 27.5 |
| 1 | 2 mm | 0.091 | not found | 27.6 |
| 2 | 3 mm | 0.130 | not found | 27.3 |
| 3 | 4 mm | 0.167 | not found | 27.4 |
| 4 | 5 mm | 0.200 | not found | 26.3 |
| 5 | 6 mm | 0.231 | found | 24.5 |

No. 0 . . . bending was not carried out

It shows that the working in which the max curvature strain exceeds 0.2, generates cracks. The magnetic properties are deteriorated as well, by the distortion in the alignment.

Embodiment 2

Plateshaped samples having a width of 10 mm, a length of 30 mm, and a thickness of 2 mm were produced by machining a rolled material produced in a process similar to that described in Embodiment 1.

The plateshaped samples were heated at 850, 900 and 1000° C., and press bending was carried out in argon atmosphere to produce arc shape magnets whose amount of strain was 2,5,15 or 25%. The results are shown in Table 2. The number of successful products is a number of samples which could be worked without generating cracks out of the total samples.

Then the sample was heat-treated in argon atmosphere at 1000° C. for 2 hours, and at 500° C. for 2 hours, then cut out into a cube of 2×2×2 mm by cutting machine, and magnetized in pulse magnetic field of 4 tesla, and the magnetic properties in the direction of plate thickness were measured by VSM. The results are shown in the same table.

TABLE 2

| No. | strain (%) | inner diameter (mm) | temperature (°C.) | number of successful products/ total samples | (BH)max (MGOe) |
|---|---|---|---|---|---|
| 1 | 0.02 | 196.0 | 850 | 5/5 | 31.0 |
| 2 | 0.05 | 76.0 | 850 | 2/5 | 30.5 |
| 3 | 0.15 | 22.7 | 850 | 0/3 | 32.4 |

TABLE 2-continued

| No. | strain (%) | inner diameter (mm) | temperature (°C.) | number of successful products/ total samples | (BH)max (MGOe) |
|---|---|---|---|---|---|
| 4 | 0.25 | 12.0 | 850 | 0/2 | 27.2 |
| 5 | 0.02 | 196.0 | 900 | 5/5 | 33.0 |
| 6 | 0.05 | 76.0 | 900 | 5/5 | 31.5 |
| 7 | 0.15 | 22.7 | 900 | 3/5 | 29.5 |
| 8 | 0.25 | 12.0 | 900 | 0/5 | 26.1 |
| 9 | 0.02 | 196.0 | 1000 | 5/5 | 29.7 |
| 10 | 0.05 | 76.0 | 1000 | 5/5 | 30.0 |
| 11 | 0.15 | 22.7 | 1000 | 5/5 | 31.2 |
| 12 | 0.25 | 12.0 | 1000 | 0/5 | 25.5 |

Table 2 shows that the working temperature is required to be at least more than or equal to 900° C., preferably, more than or equal to 1000° C. Provided that in case the amount of strain exceeds 0.2, cracks occur regardless of the working temperature. As for the magnetic properties, the working temperature is found to have almost no influence, however, when the amount of strain exceeds 0.2, the magnetic properties are deteriorated very much by the distortion in the alignment.

Embodiment 3

Plateshaped samples having a width of 10 mm, a length of 30 mm, and a thickness of 4 mm were produced by machining a rolled material produced in a process similar to that described in Embodiment 1. The plateshaped samples were heated at 1000° C. in argon atmosphere, and press bending was carried out at a different strain rate, to produce arc shape magnets having the amount of strain of 2%, 5%, 15% and 25% respectively. The results are shown in Table 3. Here, the number of successful products is a number of samples which could be worked without generating cracks out of the total samples.

Then the sample was heat-treated in argon atmosphere at 1000° C. for 2 hours, and at 500° C. for 2 hours, then cut out into a cube of 2×2×2 mm by cutting machine, and magnetized in the plate's thickness direction (radial direction) in pulse magnetic field of 4 tesla, and the magnetic properties were measured by VSM. The results are shown in the same table.

TABLE 3

| No. | strain (%) | strain rate (/s) | working speed (mm/min) | number of successful products/ total samples | (BH)max (MGOe) |
|---|---|---|---|---|---|
| 1 | 0.02 | $5\times10^{-3}$ | 11.25 | 3/5 | 29.8 |
| 2 | 0.05 | $5\times10^{-3}$ | 11.25 | 0/5 | 30.1 |
| 3 | 0.15 | $5\times10^{-3}$ | 11.25 | 0/3 | 32.5 |
| 4 | 0.25 | $5\times10^{-3}$ | 11.25 | 0/2 | 25.1 |
| 5 | 0.02 | $1\times10^{-3}$ | 2.25 | 5/5 | 32.5 |
| 6 | 0.05 | $1\times10^{-3}$ | 2.25 | 5/5 | 31.0 |
| 7 | 0.15 | $1\times10^{-3}$ | 2.25 | 5/5 | 31.5 |
| 8 | 0.25 | $1\times10^{-3}$ | 2.25 | 0/3 | 25.6 |
| 9 | 0.02 | $5\times10^{-4}$ | 1.13 | 5/5 | 29.9 |
| 10 | 0.05 | $5\times10^{-4}$ | 1.13 | 5/5 | 29.5 |
| 11 | 0.15 | $5\times10^{-4}$ | 1.13 | 5/5 | 32.8 |
| 12 | 0.25 | $5\times10^{-4}$ | 1.13 | 1/5 | 24.3 |

When the amount of strain is more than or equal to 0.05, strain rate of less than or equal to $1\times10^{-3}$ allows bending without causing cracks. Provided that in case the amount of strain exceeds 0.2, the effect of slowing the strain rate is not at all found, and the magnetic characteristics are also deteriorated very much.

Embodiment 4

Figure 2A:
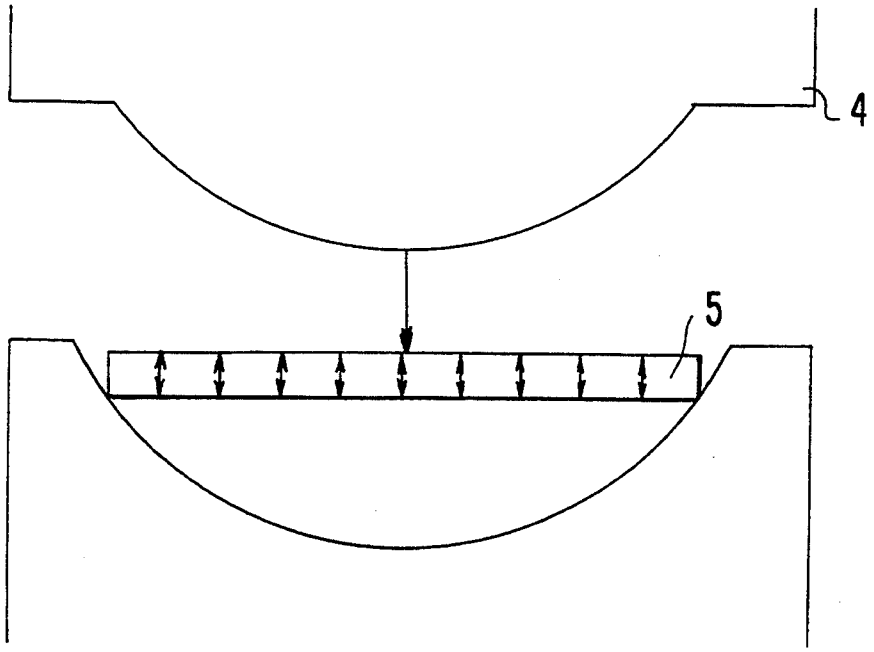
FIG. 2 is a schematic view illustrating the bending used in accordance with an embodiment of the invention, in which magnets are made anisotropic by the bending.
Figure 2B:
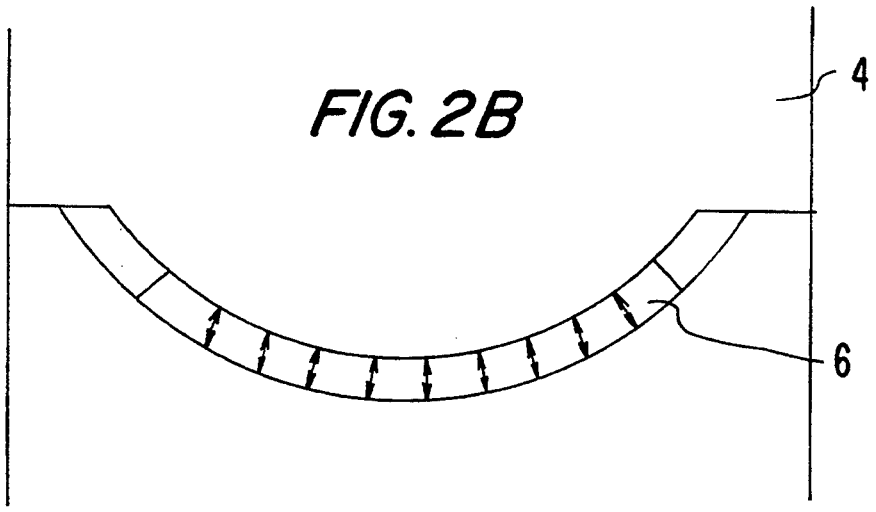

Plateshaped samples having a width of 10 mm, a length of 30 mm, and a thickness of 4 mm were produced by machining a hot-rolled material produced in a process similar to that described in Embodiment 1. As it is shown in FIG. 2, the plateshaped sample 5 was heated at 1000° C. in argon atmosphere, and press bending was carried out in such a way that the radial direction of the arc shape die 4 which was heated at the same temperature accords with the direction of the plate's thickness, and the sample 5 was molded into an arc shape magnet having an inner diameter of 38, 25 or 18 mm. The strain rate was $3\times10^{-14}$/s. As the result a good arc shape magnet which was free from cracks could be molded. It was heat-treated in argon atmosphere at 1000° C. for 2 hours, and at 500° C. for 2 hours, then cut out into a cube of 2×2×2 mm by cutting machine, and magnetized in pulse magnetic field of 4 tesla, and the magnetic characteristics in three directions were measured by VSM. The results are shown as follows. Here, the plate's thickness direction (radial direction) is shown as direction r, the length direction (circumferential direction) is shown as direction $\theta$, and the plate's width direction is shown as direction z.

TABLE 4

| No. | inner diameter (mm) | (BH)max (MGOe) direction r | 4πIs (G) direction r | direction θ | direction z |
|---|---|---|---|---|---|
| 1 | 38.0 | 31.5 | 11650 | 5102 | 5001 |
| 2 | 25.0 | 30.1 | 11430 | 5023 | 5202 |
| 3 | 18.0 | 29.5 | 11325 | 5342 | 5530 |

The values of 4πIs in three directions show that these magnets are radially oriented. Here, the alignment is very good.

Embodiment 5

Alloys having compositions shown in Table 5 were melted in argon atmosphere using an induction furnace then they were cast to produce cast ingots having a length of 150 mm, a height of 140 mm, and a thickness of 20 mm. Hot rolling was carried out in a process similar to that used in Embodiment 1, to produce plate-shaped magnets having a width of 10 mm, a length of 40 mm and a thickness of 5 mm, being anisotropic in the plate's thickness direction. As it is shown in FIG. 2, the plateshaped sample 5 was heated at 1000° C. in argon atmosphere, and press bending was carried out in such a way that the radial direction of the arc shape die 4 which was heated at the same temperature, accords with the direction of the plate's thickness, and the sample 5 was molded into a arc shape magnet 6 having an inner diameter of 40 mm. The strain rate employed was $3\times10^{-14}$/s. As the result a good arc shape magnet which was free from cracks could be molded. It was heat-treated in argon atmosphere at 1000° C. for 2 hours, and at 500° C. for 2 hours, then cut out into a cube of 2×2×2 mm by cutting machine, and magnetized in pulse magnetic field of 4 tesla, and the magnetic properties in radial direction were measured by BH tracer. The results are shown as follows.

TABLE 5

| sample No. | alloy composition | (BH)max (MGOe) |
|---|---|---|
| 1 | $Pr_{16}Fe_{79}B_5$ | 30.1 |
| 2 | $Pr_{15.5}Fe_{78.2}B_{5.1}Cu_{1.2}$ | 32.4 |
| 3 | $Pr_{16.5}Fe_{70.2}Co_{7.8}B_5Cu_{0.5}$ | 31.5 |
| 4 | $Pr_{17.3}Fe_{76.1}B_{4.6}Cu_2$ | 29.5 |
| 5 | $Pr_{10}Nd_{7.5}Fe_{76.3}B_{4.7}Cu_{1.5}$ | 29.8 |

It is found that each of the compositions No.1–5 shows high magnetic properties in radial direction.

Embodiment 6

Alloys having compositions shown in Table 6 were melted and cast in argon atmosphere using an induction furnace.

TABLE 6

| sample No. | alloy composition | x-2z | y-14z |
|---|---|---|---|
| 1 | $Pr_{11}Fe_{83.2}B_{5.8}$ | −0.6 | 2.0 |
| 2 | $Pr_{11.8}Fe_{81.3}B_{5.9}Cu_{1.0}$ | 0.0 | −1.3 |
| 3 | $Pr_{13.6}Fe_{80.6}B_{4.3}Cu_{1.5}$ | 5.0 | 20.4 |
| 4 | $Pr_{15}Fe_{79}B_5Cu_{0.8}Ti_{0.2}$ | 5.0 | 9.0 |
| 5 | $Pr_{17}Fe_{76.7}B_{5.1}Cu_{0.8}Mo_{0.4}$ | 6.8 | 5.3 |
| 6 | $Pr_{15.5}Fe_{72.2}Co_{5.8}B_5Cu_1Ag_{0.5}$ | 5.5 | 2.2 |
| 7 | $Pr_{12}Nd_3Fe_{78.2}B_{5.2}Cu_1Ga_{0.6}$ | 4.6 | 5.4 |
| 8 | $Pr_{16.2}Fe_{76.8}B_5Cu_1Al_{0.5}In_{0.5}$ | 6.2 | 6.8 |

Here, x,y,z are in accordance with the formula of $$R_xFe_yB_zM_{100-x-y-z}$$

(wherein M is at least one of Al,Ga,In,Si,Sn and transition metal elements excluding Fe, and a case where 100x—y—x=0 is included) which is deciding the composition of the alloy of the present invention.

Then hot rolling was carried out in a process similar to that of Embodiment 1, and samples having a width of 10 mm, a length of 40 mm and a thickness of 4 mm were cut out from the resulting rolled magnet. The plate-shaped samples were heated in argon atmosphere at 1000° C., and press bending was carried out at the working speed of 0.4 mm/min (strain rate of $1\times10^{-4}$/s) to mold the samples into arc shape magnets having an outer diameter of 28 mm, and an inner diameter of 24 mm. The results are shown in Table 7. Here, the number of successful products refers to the number of samples which showed no cracks after the bending was completed. It was heat-treated in argon atmosphere at 1000° C. for 2 hours, and at 500° C. for 2 hours, then cut out into a cube of 2×2×2 mm by cutting machine, and magnetized in pulse magnetic field of 4 tesla, and the magnetic properties in radial direction were measured by VSM. The results are shown in the same table.

TABLE 7

| sample No. | number of successful products/total samples used in experiments | (BH)max (MGOe) |
|---|---|---|
| 1 | 0/5 | 21.8 |
| 2 | 1/5 | 23.1 |
| 3 | 5/5 | 26.8 |
| 4 | 5/5 | 32.2 |
| 5 | 5/5 | 29.5 |
| 6 | 5/5 | 31.7 |
| 7 | 5/5 | 30.9 |
| 8 | 5/5 | 31.1 |

Table 7 shows that samples of No.3–8, the permanent magnets having such compositions that, when they are expressed as the above mentioned formula, satisfy the relation of $$x-2z \geqq 0$$

$$y-14z \geqq 0$$

do not generate cracks during bending, while samples of No. 1–2 whose compositions are out of the above mentioned range, generate cracks during bending and have low magnetic properties.

Embodiment 7

Alloys having compositions shown in Table 8 were melted and cast in argon atmosphere using an induction furnace.

TABLE 8

| sample No. | alloy composition | 100-17z |
|---|---|---|
| 1 | $Pr_{13}Fe_{81.3}B_{5.7}$ | 3.1 |
| 2 | $Pr_{13.5}Fe_{80.1}B_{5.4}Cu_{1.0}$ | 8.2 |
| 3 | $Pr_{11}Nd_4Fe_{72.8}Co_5B_{5.2}Cu_1Ag_{0.5}Ga_{0.5}$ | 11.6 |
| 4 | $Pr_{15}Fe_{77.9}B_{5.1}Cu_{1.5}Nb_{0.5}$ | 13.3 |
| 5 | $Pr_{15.5}Fe_{77.9}B_{5.1}Cu_{1.0}Si_{0.5}$ | 13.3 |
| 6 | $Pr_{11}Nd_5Fe_{77.7}B_5Cu_{0.8}V_{0.5}$ | 15.0 |
| 7 | $Pr_{16.5}Fe_{77.2}B_{4.5}Cu1.8$ | 23.5 |
| 8 | $Pr_{19}Fe_{75.3}B_{3.7}Cu_2$ | 37.1 |

Here, z is in accordance with the formula of $$R_xFe_yB_zM_{100-x-y-z}$$

(wherein M is at least one of Al,Ga,In,Si,Sn and transition metal elements excluding Fe, and a case where 100—x—y—z=0 is included) which is defining the composition of the alloy of the present invention. These compositions are in the range expressed as the relation $$x-2z \geqq 0$$

$$y-14z \geqq 0$$

which were found to have crack generation suppressing effect during bending, in the embodiment 6.

Then hot rolling was carried out in a process similar to that used in Embodiment 1, and samples having a width of 10 mm, a length of 40 mm and a thickness of 2 mm and 4 mm were cut out from the resulting rolled magnet. The plateshaped samples were heated in argon atmosphere at 1000° C., and press bending was carried out at the strain rate of $1\times10^{-4}$/s, and the samples were molded into arc shaped magnets having a bending strain of 8%. During bending, 6 samples were worked under the same condition. The results are shown in Table 9. Here, the number of successful products refers to the number of samples which showed no cracks after the bending was completed on those 6 samples.

It was further heat-treated in argon atmosphere at 1000° C. for 2 hours, and at 500° C. for 2 hours, then cut out into a cube of 2×2×2 mm by cutting machine, and magnetized in pulse magnetic field of 4 tesla, and the magnetic properties in radial direction were measured by VSM. The results are shown in the same table.

TABLE 9

| composition No. | plate's thickness | working speed (mm/min) | curvature radius (mm) | number of successful products | (BH)max (MGOe) |
|---|---|---|---|---|---|
| 1 | 2 mm | 2.40 | 13.5 | 0 | 24.6 |
| | 4 mm | 1.20 | 27.0 | 0 | 25.8 |

TABLE 9-continued

| composition No. | plate's thickness | working speed (mm/min) | curvature radius (mm) | number of successful products | (BH)max (MGOe) |
|---|---|---|---|---|---|
| 2 | 2 mm | 2.40 | 13.5 | 6 | 27.9 |
| | 4 mm | 1.20 | 27.0 | 6 | 28.8 |
| 3 | 2 mm | 2.40 | 13.5 | 6 | 31.5 |
| | 4 mm | 1.20 | 27.0 | 6 | 32.6 |
| 4 | 2 mm | 2.40 | 13.5 | 6 | 28.8 |
| | 4 mm | 1.20 | 27.0 | 6 | 30.1 |
| 5 | 2 mm | 2.40 | 13.5 | 6 | 28.9 |
| | 4 mm | 1.20 | 27.0 | 6 | 30.4 |
| 6 | 2 mm | 2.40 | 13.5 | 6 | 29.5 |
| | 4 mm | 1.20 | 27.0 | 6 | 31.5 |
| 7 | 2 mm | 2.40 | 13.5 | 6 | 28.4 |
| | 4 mm | 1.20 | 27.0 | 6 | 29.5 |
| 8 | 2 mm | 2.40 | 13.5 | 6 | 23.2 |
| | 4 mm | 1.20 | 27.0 | 6 | 24.3 |

Table 9 shows that, among the permanent magnets whose compositions are expressed as the above mentioned composition formula, No.2–7 having compositions satisfying the relation of $$5 \leqq 100-17z \leqq 35$$

can prevent generation of cracks during bending, and have high magnetic properties.

Embodiment 8

Alloys having compositions shown in Table 10 were melted and cast in argon atmosphere using an induction furnace.

TABLE 10

| sample No. | alloy composition | x-2z | y-14z | 100-17z |
|---|---|---|---|---|
| 1 | $Pr_{11}Fe_{83}B_6$ | −1.0 | −1.0 | −2.0 |
| 2 | $Pr_{11.8}Fe_{81}B_{5.9}Cu_{1.4}$ | 0.0 | −1.6 | −0.3 |
| 3 | $Pr_{12.8}Fe_{81.5}B_{5.7}$ | 1.4 | 1.7 | 3.1 |
| 4 | $Pr_{15}Fe_{72}Co_6B_{5.1}Ag_{1.2}Ga_{0.7}$ | 4.8 | 0.6 | 13.3 |
| 5 | $Pr_{15.5}Fe_{78.9}B_5Cu_{0.6}$ | 5.5 | 8.9 | 15.0 |
| 6 | $Pr_{11}Nd_{4.5}Fe_{78}B_5Cu_1Al_{0.5}$ | 5.5 | 8.0 | 15.0 |
| 7 | $Pr_{16}Fe_{77.8}B_{5.2}Cu_{0.7}Ti_{0.3}$ | 5.6 | 5.0 | 11.6 |
| 8 | $Pr_{16.5}Fe_{77.3}B_{5.2}Cu_1$ | 6.1 | 4.5 | 11.6 |
| 9 | $Pr_{17}Fe_{76.7}B_{4.5}Cu_{1.2}In_{0.6}$ | 8.0 | 13.7 | 23.5 |
| 10 | $Pr_{20}Fe_{74.8}B_{3.7}Cu_{1.5}$ | 12.6 | 23.0 | 37.1 |

Here, x,y,z are in accordance with the formula of $$R_xFe_yB_zM_{100-x-y-z}$$

(wherein M is at least one of Al,Ga,In,Si,Sn and transition metal elements excluding Fe, and a case where 100—x—y—z=0 is included) which is deciding the composition of the alloy of the present invention.

Then hot rolling was carried out in a process similar to that used in Embodiment 1, and samples having a width of 10 mm, a length of 40 mm and a thickness of 4 mm were cut out from the resulting rolled magnet. The plateshaped samples were heated in argon atmosphere at 1000° C., and press bending was carried out at the working speed of 0.4 mm/min (strain rate of $1\times10^{-4}$/s) to mold the samples into arc shaped magnets having an outer diameter of 28 mm, and an inner diameter of 24 mm. After the bending, the samples were, regardless of the presence of the cracks, a) heat-treated at 1025° C. for 6 hours, and at 500° C. for 2 hours, b) without any heat treatments, cut out into a cube of 2×2×2 mm by cutting machine, and magnetized in pulse magnetic field of 4 tesla, and the magnetic properties in radial direction were measured by VSM. The results are shown in Table 11.

TABLE 11

| sample No. | condition a iHc (kOe) | condition a (BH)max (MGOe) | condition b iHc (kOe) | condition b (BH)max (MGOe) |
|---|---|---|---|---|
| 1 | 10.2 | 22.5 | 8.4 | 20.3 |
| 2 | 11.3 | 23.6 | 9.1 | 21.2 |
| 3 | 13.8 | 26.9 | 10.6 | 23.5 |
| 4 | 16.8 | 30.4 | 13.4 | 27.7 |
| 5 | 17.3 | 32.2 | 14.3 | 29.2 |
| 6 | 15.5 | 31.9 | 12.1 | 28.6 |
| 7 | 16.0 | 31.5 | 12.7 | 28.6 |
| 8 | 16.5 | 30.6 | 13.9 | 28.8 |
| 9 | 18.1 | 26.7 | 15.5 | 24.1 |
| 10 | 18.8 | 25.1 | 16.2 | 22.4 |

The results show that, among the permanent magnets whose compositions are expressed as the above mentioned composition formula, No.4–9 having compositions satisfying the relation of $$x-2z \geqq 0$$

$$y-14z \geqq 0$$

$$5 \leqq 100-17z \leqq 35$$

retain high magnetic properties even after the bending, and the the coersive force and max energy product are enhanced by carrying out the heat treatment within a range of 250° C.–1100° C. following the bending.

Embodiment 9

Alloys having compositions shown in Table 12 were melted and cast in argon atmosphere using an induction furnace.

TABLE 12

| sample No. | alloy composition |
|---|---|
| 1 | $Pr_{16}Fe_{79}B_5$ |
| 2 | $Pr_{15.5}Fe_{78.2}B_{5.1}Cu_{1.2}$ |
| 3 | $Pr_{16.5}Fe_{70.2}Co_{7.8}B_5Cu_{0.5}$ |
| 4 | $Pr_{17.3}Fe_{76.1}B_{4.6}Cu_2$ |
| 5 | $Pr_{10}Nd_{7.5}Fe_{76.3}B_{4.7}Cu_{1.5}$ |

Then hot rolling was carried out in a process similar to that used in Embodiment 1, and a) without any heat treatment, b) after carrying out heat treatment at 1080° C. for 24 hours, samples having a width of 10 mm, a length of 40 mm and a thickness of 4 mm were cut out from the resulting rolled magnet. The planar samples were heated in argon atmosphere at 1000° C., and press bending was carried out at the working speed of 1.20 mm/min (strain rate of $3\times10^{-4}$/s) to mold the samples into arc shape magnets having an outer diameter of 25 mm, and an inner diameter of 21 mm. The results are shown in Table 13. Here, the number of successful products refers to the number of samples whose bending could be completed without generating cracks.

TABLE 13

| sample No. | average grain diameter (μm) | number of successful products/total number of samples |
|---|---|---|
| 1a | 11.6 | 5/5 |
| 1b | 28.1 | 5/5 |
| 2a | 9.6 | 5/5 |
| 2b | 15.3 | 5/5 |
| 3a | 12.2 | 5/5 |
| 3b | 27.9 | 5/5 |
| 4a | 19.8 | 5/5 |
| 4b | 40.6 | 1/5 |
| 5a | 23.2 | 5/5 |
| 5b | 45.7 | 0/5 |

The result shows that those having grain diameter of more than or equal to 40 μm after the hot working, have bad workability and generate cracks during bending. It is also shown that the crystal grain is grown by the heat treatment and that leads to the deterioration of workability.

Embodiment 10

An alloy having the composition of $Pr_{15.5}Fe_{78.2}B_{5.1}Cu_{1.2}$ was melted and cast in argon atmosphere using an induction furnace. Planar samples having a width of 10 mm, a length of 30 mm, and a thickness of 2–6 mm were cut out from a rolled magnet produced by hot rolling in a process similar to that described in Embodiment 1. The plateshaped samples were heated at 1000° C. in argon atmosphere, and press bending was carried out with different strain rates during the bending and they were molded into arc shape magnets having the bending strain of 7.5%. Here, 6 samples were worked under each condition and following two kinds of steps were employed.

a) after the hot rolling, samples were cut out without carrying out heat treatment and bending was carried out. Then heat treatment was carried out at 1050° C. for 12 hours then at 500° C. for 6 hours. The average grain diameter prior to the bending was 10.2 μm.

b) after the hot rolling, heat treatment at 1100° C. was carried out for 12 hours then the samples were cut out and bending was carried out. Then heat treatment was further carried out at 500° C. for 6 hours. The average grain diameter prior to the bending was 45.0 μm. The results are shown in Table 14. Here, the number of successful products refers to the number of samples which showed no cracks after the bending was completed on those 6 samples.

Then it was cut out into a cube of 2×2×2 mm by cutting machine, and magnetized in pulse magnetic field of 4 tesla, and the magnetic properties in radial direction were measured by VSM. The results are shown in the same table.

TABLE 14

| thickness of plate (mm) | curvature radius (mm) | working speed (mm/min) | strain rate (/s) | step a number of successful products | step a (BH)max (MGOe) | step b number of successful products | step b (BH)max (MGOe) |
|---|---|---|---|---|---|---|---|
| 2 | 14.3 | 1.20 | $1.5\times10^{-4}$ | 6 | 28.8 | 6 | 27.9 |
| | | 2.40 | $3.0\times10^{-4}$ | 6 | 28.3 | 3 | 27.8 |
| | | 4.00 | $5.0\times10^{-4}$ | 6 | 29.1 | 1 | 28.5 |
| | | 8.00 | $1.0\times10^{-3}$ | 6 | 29.2 | 1 | 27.7 |
| 4 | 28.5 | 0.60 | $1.5\times10^{-4}$ | 6 | 30.5 | 6 | 29.6 |
| | | 1.20 | $3.0\times10^{-4}$ | 6 | 30.5 | 1 | 30.3 |

TABLE 14-continued

| thickness of plate (mm) | curvature radius (mm) | working speed (mm/min) | strain rate (/s) | step a number of successful products | step a (BH)max (MGOe) | step b number of successful products | step b (BH)max (MGOe) |
|---|---|---|---|---|---|---|---|
| | | 2.00 | $5.0 \times 10^{-4}$ | 6 | 30.8 | 1 | 29.9 |
| | | 4.00 | $1.0 \times 10^{-3}$ | 6 | 30.7 | 0 | 29.5 |
| 6 | 43.0 | 0.40 | $1.5 \times 10^{-4}$ | 6 | 32.1 | 6 | 30.9 |
| | | 0.80 | $3.0 \times 10^{-4}$ | 6 | 30.8 | 1 | 30.7 |
| | | 1.33 | $5.0 \times 10^{-4}$ | 6 | 32.0 | 0 | 11.9 |
| | | 2.67 | $1.0 \times 10^{-3}$ | 6 | 32.3 | 0 | 30.8 |

From these results, it is clear that the deterioration of the workability due to the growth of the crystal grain and generation of the cracks during bending can be prevented and high magnetic properties can be obtained by carrying out hot bending by removing such a process that causes the grain growth prior to the bending.

Embodiment 11

An alloy having the composition of $Pr_{16}Fe_{77.7}B_{5.1}Cu_{1.2}$ was melted and cast in argon atmosphere using an induction furnace then hot rolling was carried out in a process similar to that used in Embodiment 1. Then, 1) without carrying out heat treatment, 2) after heat treatment at 1050° C. for 12 hours, planar samples having a width of 10 mm, a length of 40 mm, and a thickness of 4 mm were cut out from the resulting rolled magnet. The plateshaped samples were heated at 1000° C. in argon atmosphere, and press bending was carried out at a strain rate of $1.0\times10^{-4}$/s and they were molded into arc shape magnets having a bending strain of 7.5%. Following the bending, the samples were, regardless of the presence of cracks, a) heat-treated at 1025° C. for 6 hours and at 500° C. for 2 hours, b) without carrying out any heat treatment, cut out into a cube of 2×2×2 mm by cutting machine, and magnetized in pulse magnetic field of 4 tesla, and the magnetic properties in radial direction were measured by VSM. The results are shown in Table 15.

TABLE 15

| sample No. | average grain diameter (μm) | condition a iHc (kOe) | condition a (BH)max (MGOe) | condition b iHc (kOe) | condition b (BH)max (MGOe) |
|---|---|---|---|---|---|
| 1 | 10.5 | 17.0 | 32.5 | 13.8 | 28.6 |
| 2 | 40.7 | 14.1 | 28.8 | 11.2 | 24.9 |

The results show that the hot bending removing such a step that causes the grain growth prior to the bending, provides products having high magnetic properties. It is also found that the coersive force and max energy product were improved by the heat treatment at a temperature in a range of 250° C.-1100° C. following the bending.

Embodiment 12

Alloys having compositions shown in Table 16 were melted and cast in argon atmosphere using an induction furnace. Then samples having a width of 10 mm, a length of 40 mm and a thickness of 4 mm were produced by machining a rolled magnet produced by carrying out hot rolling in a process similar to that used in Embodiment 1. The planar samples were heated at 1000° C. in argon atmosphere and press bending was carried out to mold them into circular arc shape magnets having a bend radius of an inner surface of 30 mm.

After the working, before they were cooled, heat treatment was carried out at 1000° C. for 2 hours then they were cooled to 500° C. at the cooling speeds shown in Table 2, then heat treatment at 500° C. was carried out for 2 hours and they were cooled to room temperature at the same cooling speed. They were cut out into a cube of 2×2×2 mm by cutting machine, and magnetized in pulse magnetic field of 4 tesla, and the magnetic properties in radial direction were measured by VSM. The presence of cracks in the samples and the magnetic properties are shown in Table 16.

TABLE 16

| No. | composition | cooling rate °C./min | cracks | (BH)max (MGOe) |
|---|---|---|---|---|
| 1 | $Pr_{16}Fe_{77.8}B_{5.2}Cu_1$ | 10 | none | 30.5 |
| 2 | $Pr_{12}Nd_4Fe_{77.8}B_{5.2}Cu_1$ | 20 | none | 29.5 |
| 3 | $Pr_{17}Fe_{78}B_5$ | 50 | present | 25.3 |
| 4 | $Pr_{16}Fe_{67.8}Co_{10}B_{5.2}Al_1$ | 100 | present | 27.4 |
| 5 | $Nd_{16}Fe_{77.8}B_{5.2}Mo_1$ | 10 | none | 24.5 |
| 6 | $Nd_{16}Fe_{76.5}B_5Cu_{1.5}$ | 20 | none | 30.5 |
| 7 | $Nd_{16}Fe_{76.5}B_5Ag_{1.5}$ | 50 | present | 31.2 |
| 8 | $Pr_{14}Dy_3Fe_{76.5}B_5Ga_{1.5}$ | 100 | present | 24.5 |

It is shown that the presence of the cracks in the sample highly depends on the cooling rate and that no cracks are generated when the speed is less than or equal to 20° C./min.

Embodiment 13

Plateshaped samples having a width of 10 mm, a length of 40 mm, and a thickness of 2 mm were produced by machining a rolled material produced in a process similar to that used in Embodiment 1, and a graphite type lubricant and a glass type lubricant for an oxidation resistance coating were sprayed on some of the samples. They were heated in air at 1000° C., and press bending was carried out to produce arc shape magnets having a bend radius of an inner surface of 30 mm.

After the process, an oxide membrane on the sample surface was removed and the weight change was measured. It was heat-treated in argon atmosphere at 1000° C. for 2 hours, and at 500° C. for 2 hours, and cut out into a cube of 2×2×2 mm by cutting machine, and magnetized in pulse magnetic field of 4 tesla, then the magnetic properties in radial direction were measured by VSM. The results are shown in Table 17.

TABLE 17

| No. | atmosphere | oxidation resisting coating | weight of oxidized part (%) | (BH)max (MGOe) |
|---|---|---|---|---|
| 0 | Ar | none | 0.10 | 27.5 |
| 1 | air | none | 5.61 | 26.5 |

TABLE 17-continued

| No. | atmosphere | oxidation resisting coating | weight of oxidized part (%) | (BH)max (MGOe) |
|---|---|---|---|---|
| 2 | air | graphite type | 0.52 | 27.3 |
| 3 | air | glass type | 0.56 | 27.4 |

It is found that the oxidation of the magnet material can be greatly suppressed by the oxidation resistance coating and that the coating also has an effect of preventing the deterioration of the magnetic properties. They have high lubricating and mold releasing effects as well, and there was almost no damage given on dies.

INDUSTRIAL APPLICABILITY

As described above, the method of producing a rare-earth permanent magnet of the present invention has following advantages.

(1) Compared with the conventional sintering method, melt spinning method and die up set method, the present invention has simpler production process, and the number of working steps and the amount of investment for production can be greatly reduced, thus a magnet of a low cost can be produced.

(2) Compared with the arc shape magnet produced by the conventional sintering method, melt spinning method and die up set method, a high-performance magnet having higher size precision, mechanical strength and radial anisotropy can be produced. Since the pulverization process is not included, the product has a low oxygen content and high corrosion resistance.

(3) Molding can be done without generating cracks by deciding such bending conditions as the amount of strain, the working temperature, the strain rate, the cooling rate after the working, as well as by deciding the composition and the grain diameter of the magnet alloy, in detail.

(4) A high-performance radial anisotropic magnet of high size precision can be produced in accordance with the present invention.

(5) High coersive force and energy product can be obtained by optimizing the heat treatment after the bending.

(6) Working cost can be lowered by the use of an oxidation resistance coating agent, since the bending can be done at a high temperature in air, and the controlling of the atmosphere is not required for the furnace and the machine.

We claim:

1. A method of producing a rare-earth permanent magnet, comprising the steps of:

melting raw material including R (R is at least one of the rare earth elements including Y), Fe (iron) and B (boron) as the basic constituents and casting the melt into a cast alloy ingot of permanent magnet material, hot working the cast alloy ingot to form an anisotropic plate shaped magnetic material, hot bending the plate shaped magnetic material at a temperature in the range of about 900°–1050° C. at a strain rate of not more than 0.001 $sec^{-1}$ such that the maximum bending strain $\epsilon max$ which is expressed as $\epsilon max = t/(2r+t)$ (wherein r is a curvature radius of an inner surface of the plate shaped material and t is the thickness of the plate) is less than or equal to 0.2.

2. The method of producing a rare-earth permanent magnet according to claim 1, wherein said hot bending is executed such that $\epsilon max = 0.05 - 0.2$.

3. The method of producing a rare-earth permanent magnet according to claim 1, wherein the plate shaped magnetic material has a thickness and the plate is deformed into an arc shape during the hot bending step so that the radial direction of the arc shaped material corresponds to the direction of thickness of the plate shaped material.

4. The method of producing a rare-earth permanent magnet according to claim 1, wherein the composition of the cast alloy ingot, in terms of atomic %, is $R_xFe_yB_zM_{100-x-y-z}$ wherein, M is at least one of Al, Ga, In, Si, Sn and transition metal elements except for Fe, and $$x-2z>0$$

$$y-14z>0$$

$$5 \leqq 100-17z \leqq 35 \text{ and}$$

$x+y+z$ can equal 100.

5. The method of producing a rare-earth permanent magnet according to claim 1, wherein the average crystal grain diameter of the cast alloy ingot prior to the hot bending step is less than or equal to 40 $\mu m$.

6. The method of producing a rare-earth permanent magnet according to claim 4, wherein after the hot bending step, the bent plate shaped magnetic material is heat treated at a temperature from 250°–1100° C.

7. The method of producing a rare-earth permanent magnet according to claim 1, wherein following the hot bending step, and without first carrying out a cooling step, the bent plate shaped material is heat treated, at 500°–1100° C. for 2–24 hours, and then at 200°–700° C. for 2–24 hours, and the cooling rate employed after said heat treatments is less than or equal to 20° C./min.

8. The method of producing a rare-earth permanent magnet according to claim 1, wherein a lubricant having oxidation resistance properties is coated on the plate shaped magnetic material before said hot bending is carried out.

9. The method of producing a rare-earth permanent magnet according to claim 5, wherein after the hot bending step, the bent plate shaped magnetic material is heat treated at a temperature from 250°–1100° C.

* * * * *